United States Patent [19]

Dorsch

[11] 4,095,727

[45] Jun. 20, 1978

[54] APPARATUS FOR DISPENSING A LIQUID FROM A CONTAINER

[76] Inventor: Dieter Dorsch, Tscherningstr. 22, Heilbronn, Germany D-7100

[21] Appl. No.: 704,054

[22] Filed: Jul. 9, 1976

[30] Foreign Application Priority Data

Jul. 16, 1975 Germany ..... 2531697

[51] Int. Cl.[2] ..... B67D 5/54

[52] U.S. Cl. ..... 222/400.8; 222/559

[58] Field of Search ..... 222/401, 400.8, 396, 222/559; 251/239, 241, 325; 92/250, 169 (U.S. only)

[56] References Cited

U.S. PATENT DOCUMENTS

| | | | |
|---|---|---|---|
| 1,344,801 | 6/1920 | Kitaoka | 222/400.8 X |
| 2,031,172 | 2/1936 | Maloney | 222/400.8 X |
| 2,109,259 | 2/1938 | Yirava | 222/401 X |
| 2,241,097 | 5/1941 | Mezzapesa | 222/401 X |
| 3,198,405 | 8/1965 | Pfeil | 222/400.8 |
| 3,272,404 | 9/1966 | Graves et al. | 222/396 |
| 3,300,102 | 1/1967 | Budzich | 222/400.8 X |
| 3,343,804 | 9/1967 | Pinke | 251/241 |

*Primary Examiner*—Robert B. Reeves
*Assistant Examiner*—John P. Shannon
*Attorney, Agent, or Firm*—Kurt Kelman

[57] ABSTRACT

An apparatus for dispensing liquid from a container is locked to the container rim and comprises an air inlet for delivering air under superatmospheric pressure to the interior of the container above the liquid level therein, a check valve in the inlet for preventing air from escaping, a tap standpipe defining an air channel arranged for connection to the inlet, a liquid outlet in communication with the bottom of the chamber, and a shutoff valve for closing the outlet.

13 Claims, 4 Drawing Figures

APPARATUS FOR DISPENSING A LIQUID FROM A CONTAINER

The present invention relates to apparatus for dispensing a liquid, such as beverages, from a closed container defining an interior chamber holding the liquid from the bottom of the chamber to a predetermined liquid level.

Carbonated beverages, such as beer, have been dispensed with more or less complicated tapping apparatus disposed and locked on the container holding the beverage by pressing the beverage under carbon dioxide pressure throgh a standpipe or riser out of the container.

Compared to dispensing the beer through an air pipe and faucet, this has the advantage that the beer remains under pressure while tapped and retains its carbonation, which makes it possible to store the beer after tapping without deteriorating its quality. Its disadvantage resides in the fact that, due to certain technical requirements, such as the reduction of the carbon dioxide pressure from about 60 atmospheres to atmospheric, the apparatus is subject to malfunctioning. The apparatus also is relatively complex and, therefore, expensive wherefore it has failed to find a mass market. Dripping after the faucet has been closed is also unavoidable because of the relatively long outlet pipe.

The apparatus also involves considerable danger of explosion of the carbon dioxide cartridge or of the container. The use of carbon dioxide cartridges increases the price to the consumer by about 10%.

It is the primary object of this invention to provide simple dispensing of liquids without danger of explosion while permitting the liquid to be stored in the container after the container has been tapped and without deterioration of the liquid's quality, and to obtain all of these functions economically.

The above and other objects are accomplished in accordance with the invention with an air inlet for delivering air into the container chamber above the liquid level, means for imparting superatmospheric pressure to the air whereby the air is delivered to the chamber under pressure, a check valve in the inlet for preventing the air under pressure from escaping from the chamber, a tap standpipe defining an air channel arranged for connection to the inlet and in communication with the bottom of the container chamber, a liquid outlet in communication with the tap standpipe, and a shutoff valve for closing the outlet.

Such an apparatus may be readily disposed and locked fluid-tightly on the container above the chamber. Immediately after tapping and without first operating the pressure imparting means, a certain amount of the liquid under air pressure in the container chamber may be readily dispensed by opening the shutoff valve. After the pressure acting on the liquid has been reduced, the pressure imparting means is operated until a pressure has been restored in the container chamber sufficient to produce the desired stream of liquid. With beer as the liquid, the desired amount of foaming may thus be controlled, the foaming being a function of the pressure on the beer at any given temperature of the beer. The air pressure, which is produced in the container chamber through a narrow air channel in the tap standpipe, is maintained by the check valve which remains closed even under the smallest pressure differentials. When under spring bias, such a check valve may remain closed and provide a fluid-tight seal even in the absence of air pressure. Depending on the spring bias and the effective area of the valve head, the check valve will be opened under a predetermined pressure produced by the pressure imparting means delivering air under pressure through the inlet of the chamber. The spring bias is so proportional in relation to the effective valve head area that the valve is opened when the product of pressure times effective valve head area is greate than the closing bias of the spring. This state exists when there is no pressure in the container chamber. When this pressure is increased by operation of the air pressure imparting means, an air cushion is produced above the liquid level, thus increasing the force required to open the check valve. Since operation of the pressure imparting means compresses the air ahead of and behind the check valve, a predetermined stroke of the pressure imparting means will fix a maximum air pressure obtainable by operation thereof, which will be chosen below the bursting pressure of the container. Thus, any danger of a container explosion is avoided.

The above and other object, advantages and features of the present invention will become more apparent from the following detailed description of some now preferred embodiments thereof, taken in conjunction with the accompanying drawing therein FIG. 1 shows one embodiment of the liquid dispensing apparatus in longitudinal section, in closed condition;

Figure 1:
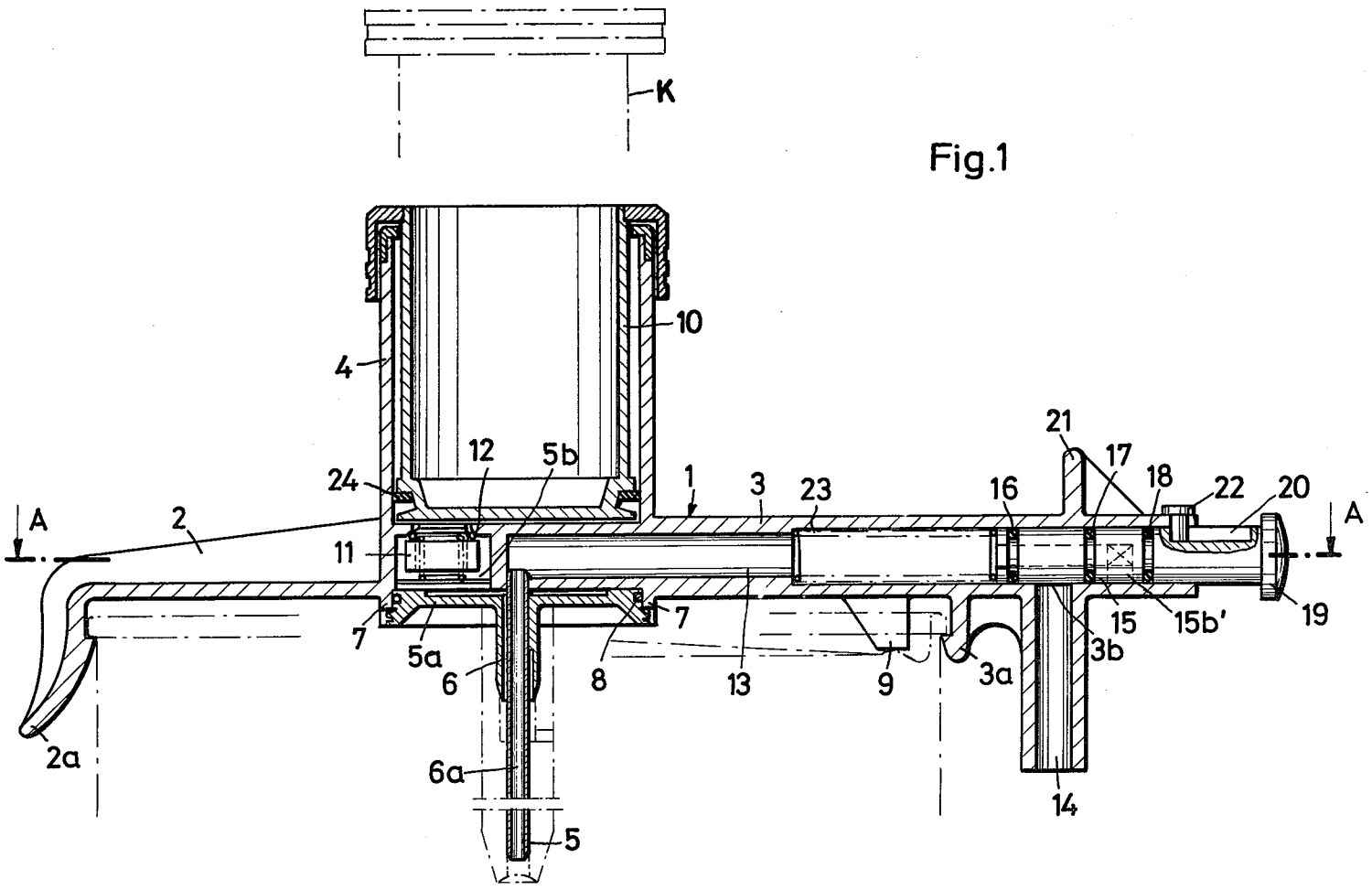
Figure 3:
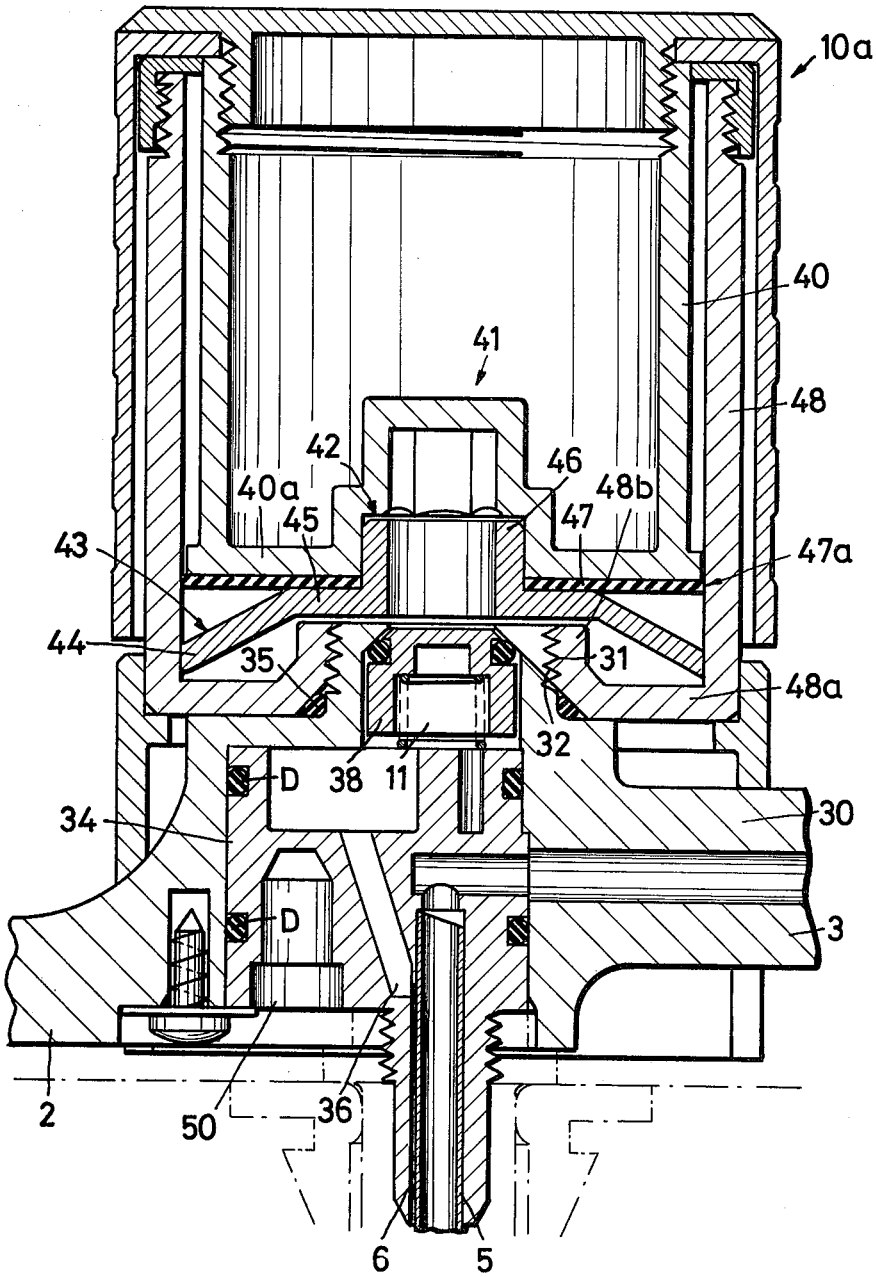
FIG. 3 illustrates another embodiment of the pressure imparting means of the liquid dispensing apparatus, in longitudinal section.

Referring now to the drawing, wherein like reference numerals designate like parts operating in a like manner in all Figures, and first to FIG. 1, the apparatus is shown comprised of integral housing 1. However, the apparatus may consist of several assembled parts and, as shown in FIG. 3, the pressure imparting means may comprise a pressure producing element mounted in a casing which is detachably and sealingly mounted on the remainder of the apparatus. In this manner, the detachable pressure imparting means may also be used with containers holding carbon dioxide cartridges so that, in such known tapping devices, compressed air may replace carbon dioxide pressure.

The housing has two clamps 2 and 3 arranged for disposing and locking the housing on the container B (shown in chain-dotted lines), the clamps having respective inner ends between which projects cylindrical casing 4 which receives and guides the air pressure imparting means illustrated as piston 10. Any suitable means may be used for locking housing 1 on the container, such as screws, clamps or the like, the illustrated means consisting of rims 2*a* and 3*a* snapped over the cover of the container (also shown in chaindotted lines).

As shown in FIG. 1, the container cover is recessed and insert 9 projects from the underside of clamp 3 for spacing the clamp from the cover and supporting the clamp in fixed relationship thereto whereby apparatus housing 1 is fixedly held on container B and locked in position to avoid movement of casing 4. Spacing element 9 is preferably elongated and conforms to the curvature of the container rim.

While the means for imparting superatmospheric pressure to the air is illustrated as an air pump, it may take any desirable form, such as a rubber ball or a bellows. In the embodiment shown in FIG. 1, this means comprises piston 10 reciprocable in casing 4. The casing has downwardly projecting rim 7 providing a fluid-tight seat for tap standpipe or riser 5 which is in communication with the bottom of the container chamber (not shown) and through which the liquid is pressed up and dispensed. The tap standpipe has mounting ring 5*a* at the upper end thereof, which fits into rim 7, annular gasket 8 being interposed between rim 7 and the circumference of mounting ring 5*a*. The mounting ring may form a snap fit with seat 7 which makes it easy to assemble the tap standpipe with housing 1 without any use of tools or expertise.

Casing 4 has a bottom defining an opening in which check valve 11 is disposed. The opening forms valve seat 12 which is preferably conical, as illustrated. Piston 10 is operated by ram K and is sealingly guided by casing 4 by means of membrane-like annular gasket 24. This gasket operates as a fluid-tight seal only during the downward stroke of the piston when the rim of the gasket will be pressed against the guiding wall of casing 4. When the piston is pulled out, a vacuum is produced immediately after the check valve is closed between the wall of casing 4 and the rim of the piston, thus causing the rim of gasket 24 to be sucked downwards and permitting air to enter into the casing while the piston is moved outwardly.

As shown, the standpipe or riser is mounted in a hub extending inwardly from mounting ring 5*a*. The hub defines air channel 6, with the standpipe and this air channel is of a cross section considerably smaller than the cross section of liquid channel 6*a* in the standpipe. Air channel 6 is in communication with opening 5*b* in housing 1, which forms the air inlet and in which check valve 11 is mounted.

FIG. 3 shows an alternative embodiment of an air pump 10*a*. The guidance of the reciprocable piston is improved in this embodiment and the structural part receiving the check valve and a relief valve provided in this embodiment, as well as the seating of the standpipe are more stable.

As shown, piston 40 is movable in casing 48 which is open on top and the piston includes bottom 40*a* having an outer face, membrane 47 loosely mounted on the outer bottom face and having circumferential rim 47*a* sealingly engaging the inner casing wall, and casing bottom 48*a* defining a central port in communication with check valve 11. Attachment 30 sealingly mounts the casing bottom on the clamps.

Bottom 40*a* of the axially reciprocable piston comprises central, stepped projection 41, step 42 in the projection defining a seat. Insert 43 consists of downwardly tapering conical rim section 43, adjoining annular section 45 and cylindrical hub section 46 projecting upwardly from the annular section. The hub section frictionally engages central stepped projection 41 and the upper rim of the hub section engages step 42 in the projection which provides the seat for insert 43. Membrane 47 has a central opening through which hub section 46 extends and the membrane is held between the outer face of the piston bottom 40*a* and the annular section 45 of insert 43.

Insert 43 reinforces and provides an improved guide for the reciprocation of piston 40 in the cylindrical casing 48 while also serving as a mounting for sealing membrane 47. As in the embodiment of FIG. 1, membrane 47 serves as a fluid-tight seal only during the downward stroke of piston 40 when rim 47*a* will be pressed against the wall of casing 48. When the piston is pulled out, a vacuum is produced below membrane 47 immediately after check valve 11 is closed causing piston bottom 40*a* to be lifted slightly off the membrane and producing a gap between membrane rim 47*a* and the casing wall to permit air to pass. Insert 43 glides along the inner wall of casing 48 with a slight clearance.

Inwardly projecting annular collar 48*b* surrounds and defines the central opening in piston bottom 48*a* and, in the illustrated embodiment, collar 48*b* has inner thread 31 engaging outer thread 32 on attachment 30 whereby air pump 10*a* is detachably mounted on clamps 2 and 3, gaskets 35 being interposed between attachment 30 and the piston bottom to provide a fluid-tight seal therebetween. As shown, check valve 11 is mounted in collar 48*b*. Thus, the air pump constitutes a compact unit which may be readily assembled and disassembled with the other parts of the apparatus. Attachment 30, which mounts the air pump unit, projects upwardly from the housing formed by clamps 2 and 3. The ready dismounting of the air pump unit makes it possible to operate with a carbon dioxide cartridge instead of the air pump, this cartridge being arranged in a suitable housing therefor and being combined with a suitable pressure reduction valve.

As shown, attachment 30 defines a chamber accommodating valve head 38 of check valve 11, this chamber being downwardly delimited by insert 34 held in the attachment between clamps 2 and 3. As illustrated, the check valve is spring-biased by a spring mounted between a shoulder in the valve head and insert 34. Gaskets D provide a fluid-tight seal between attachment 30 and insert 34 which has a bore holding tap standpipe 5 and defining air channel 6 therewith. Air inlet bore 36 extends in insert 34 between check valve 11 and the air channel.

Preferably and as shown in FIG. 3, a pressure relief valve is mounted in valve housing in insert 34 in communication with air channel 6 to relieve excess pressure developing inside the container.

One embodiment of an outlet for the dispensed liquid and a shutoff valve therefor is shown in FIG. 1. As has been indicated hereinabove, the apparatus is disposed and locked on the container by a housing including clamps 2 and 3. As illustrated, clamp 3 defines liquid conduit 13 having one end in communication with liquid outlet channel 6*a* in tap standpipe 5 and another end in communication with liquid outlet 14. Liquid conduit 13 is open at the free end of clamp 3 to receive shutoff valve 15 which consists of plug 15*a* axially movably mounted in conduit 13. Sealing gaskets 16, 17, 18 mount the plug sealingly in the conduit. The plug has an inner end in the conduit and defines axial bore 15*b* extending from the inner end and transverse bore 15*b*′ extending outwardly from the axial bore for communication with liquid outlet 14 upon axial movement of the plug. Depending on the axial position of plug 15*a*, outlet 14 will be in or out of communication with conduit 13, the outlet thus either dispensing liquid or being closed. The outer end of the plug projects from conduit 13 and comprises an actuating member consisting of knob 19 for moving plug 15*a* axially in the conduit.

When the plug is moved into the axial position wherein gaskets 17 and 18 are disposed at either side of port 3*b* in the wall of clamp 3, with the port leading to outlet 14 between the two gaskets, transverse bore 15*b*′ in plug 15*a* will be in communication with the outlet and liquid will be dispensed. The plug defines an axially extending, elongated guide groove 20 cooperating with pin 22 mounted in the wall of the clamp to guide the plug during axial movement and hold it against rotation. Axial movement of the plug by means of knob 19 will be facilitated by providing web 21 on clamp 3, which enables the operator to grasp the web with a finger while pressing the palm of the hand agsinst the knob to move the plug inwardly. By providing spring 23 in conduit 13 to press against the plug, the shutoff valve will be closed automatically by spring bias when the operator releases knob 19.

Mounting shutoff valve 15 near outlet 14 simplifies the structure and has the additional advantage of avoiding dripping of residual liquid after the valve has been closed, which is encountered in conventional taps with an outlet pipe of a length of about 15 cm. It also provides dependable tapping of the liquid.

Figure 4:
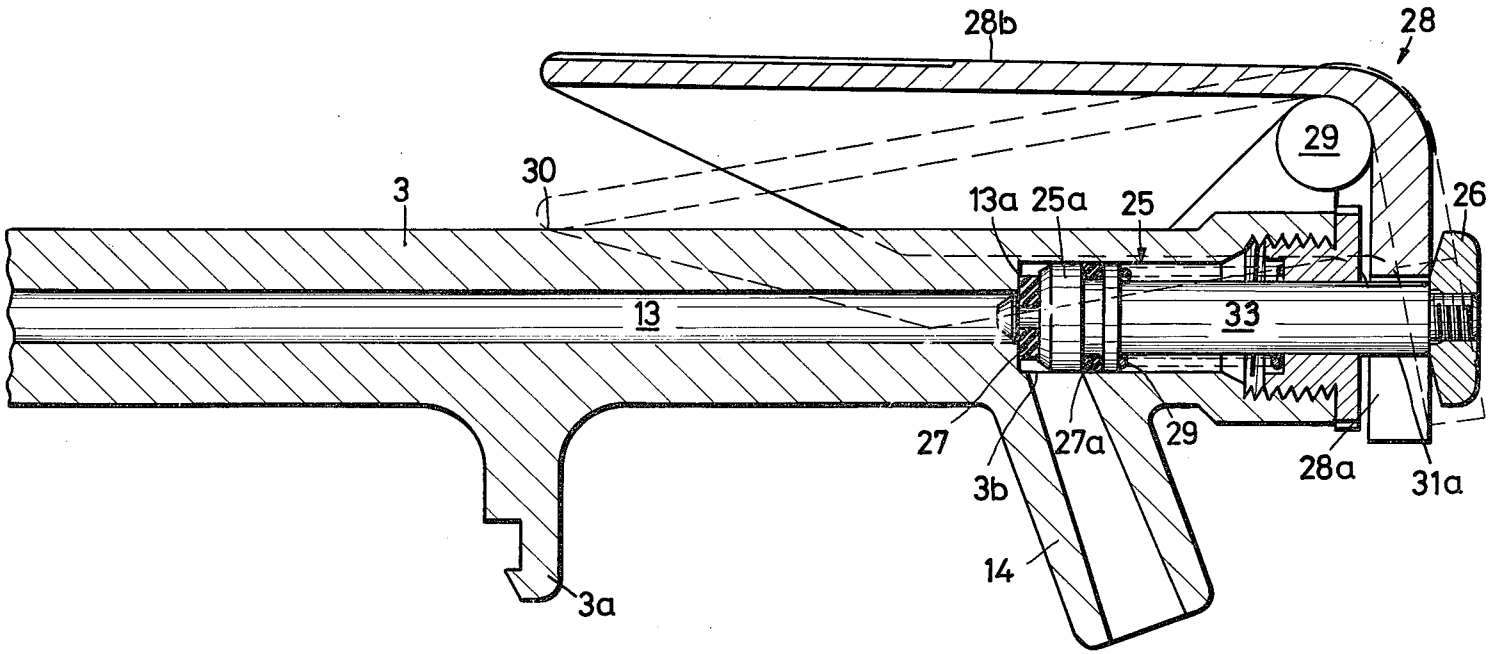
FIG. 4 is a like section of another embodiment of the shutoff valve of the apparatus.

FIG. 4 illustrates another embodiment of a shutoff valve permitting a somewhat easier operation. In this embodiment, too, shutoff valve 25 consists of a plug axially movable in liquid conduit 13 and an actuating member connected to the plug but plug 25*a* is solid and knob 26 is operated by bell crank lever 28. The bell crank lever has short arm 28*a* which engages the plug between the outer end of clamp 3 and knob 26, and long arm 28*b*. The long lever arm extends spaced from clamp 3 and is depressable thereagainst for operating the actuating member. As indicated in broken lines, when the lever arm 28*b* is depressed, lever arm 28*a* is rocked about pivot 29 outwardly to move plug 25*a* axially from its closing into a dispensing positon.

Figure 2:
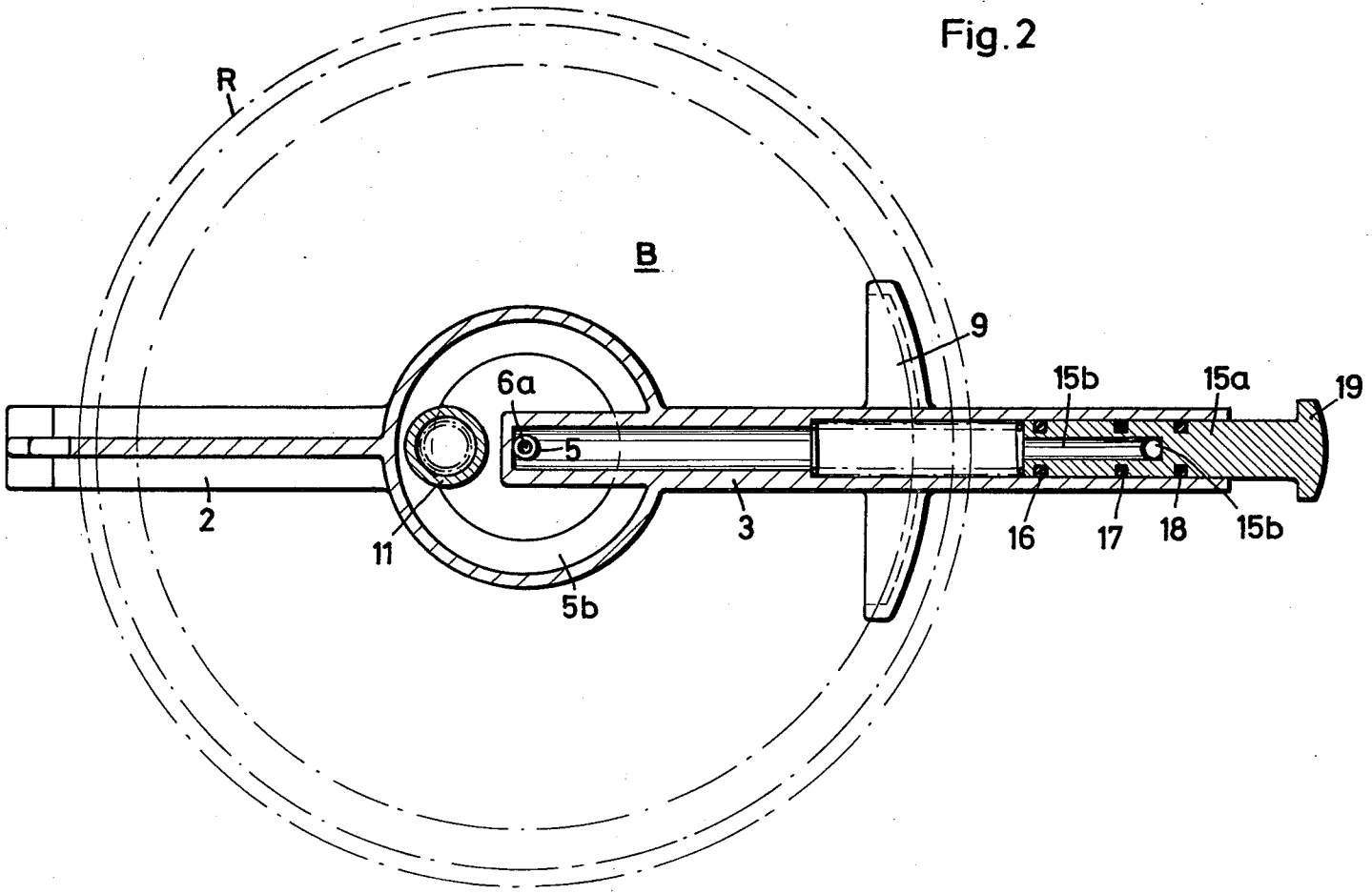
FIG. 2 is a horizontal section along line A—A of FIG. 1.

This shutoff valve may be used instead of that shown in FIGS. 1 and 2 with the air pump of either FIG. 1 or FIG. 3, only the shutoff valve structure being shown in FIG. 4. As shown, shutoff valve 25 comprises plug 25*a* which is connected to knob or disc 26 by plunger 33, the plug moving axially in a widened conduit section forming shoulder 13*a* with conduit 13, the shoulder serving as a valve seat engaged by gasket 27. A bearing in the outer end of the widened conduit section glidably receives plunger 33 and spring 29 is mounted between a shoulder on the plunger and the bearing to bias plug 25*a* and gasket 27 towards the valve seat and thus normally hold the valve in its shutoff position, interrupting communication between liquid outlet conduit 13 and bore 3*b* leading to outlet 14, gasket 27*a* being mounted between plug 25*a* and the shoulder on the plunger provide a fluid-tight seal.

Short operating lever arm 28*a* has a slot receiving projecting portion 31*a* of plunger 33 and is in contact with knob 26, and the bell crank lever is pivotally mounted at the apex formed by the two lever arms, pivot 29 being mounted on clamp 3 and upper surface 30 of clamp 3 defining a stop for long lever arm 28*b* for delimiting the pivoting stroke thereof. In the illustrated embodiment, the long lever arm is of U-shaped cross section shaped to conform to the configuration of the clamp whereby arm 28*b* will mate with clamp 3 when it is depressed into the position shown in broken lines, in which arms 28*a* will force the shutoff valve into the open position providing communication between conduit 13 and outlet 14. Upon release of handle 28*b*, spring 29 will automatically return the valve into the closed position. The operating lever provides a compact, dependable operation of the shutoff valve, the stability of the structure being increased to proportioning lever arm 28*b* so that it extends inwardly to a plane defined by clamping rim 3*a* which locks the apparatus to the container.

The apparatus hereinabove described and herein illustrated by way of example is easy to operate by anyone and trouble-free. The liquid, such as a carbonated beverage, may remain stored in the container even after it has been tapped. Storage and tapping is less expensive than with the conventional carbon dioxide operated dispensers, there is no danger of explosion, and great economies are obtained in construction and operation.

What is claimed is:

1. An apparatus for pumping a liquid under air pressure from a container having a rim and defining an interior chamber holding the liquid from the bottom of the chamber to a predetermined liquid level, an air space being defined between the liquid level and the rim, the apparatus being disposed and locked on the container above the air space, which apparatus is a unit comprising a. a housing defining an air inlet for delivering air into the air space and including two clamps engageable with the rim of the container for disposing and locking the housing of the container, b. means mounted on the housing for imparting superatmospheric pressure to the air whereby the air is delivered to the space under said pressure, c. a check valve in the inlet for preventing the air under pressure from escaping from the space, d. a tap standpipe in communication with the bottom of the chamber and defining an air channel arranged for connection to the inlet, the air channel being in communication with the space, whereby the superatmospheric pressure in the space above the liquid level pumps the liquid into and through the standpipe, e. a liquid outlet in communication with the tap standpipe, 1. one of the clamps defining a bore constituting a liquid conduit having one end in communication with the tap standpipe and receiving the liquid therefrom and another end in communicating with the liquid outlet for delivering the liquid thereto, and f. a shutoff valve mounted in the liquid conduit for selectively opening and closing the outlet.

2. The apparatus of claim 1, wherein the shutoff valve consists of a plug axially movably mounted in the conduit, the plug having an inner end in the conduit and defining an axial bore extending from the inner end and a transverse bore extending outwardly from the axial bore for communication with the liquid outlet upon axial movement of the plug, and sealing gasket means for sealingly mounting the plug in the conduit.

3. The apparatus of claim 2, wherein the outer end of the plug projects from the conduit and comprises an actuating member for moving the plug axially in the conduit.

4. The apparatus of claim 1, wherein the shutoff valve consists of a plug movably mounted in the conduit and an actuating member connected to the plug, and further comprising a bell crank lever for operating the actuating member, the operating lever having a short and a long arm connected at an apex, the short lever arm engaging the actuating member and the long lever arm extending spaced from the one clamp and being depressable thereagainst for operating the actuating member.

5. The apparatus of claim 4, wherein the operating lever is pivotally mounted at the apex formed by the two lever arms.

6. The apparatus of claim 5, wherein the operating lever is pivotally mounted on the one clamp.

7. The apparatus of claim 5, wherein the upper surface of the one clamp defines a stop for the long lever arm for delimiting the pivoting stroke thereof.

8. The apparatus of claim 7, wherein the long lever arm is of U-shaped cross section shaped to conform to the configuration of the one clamp.

9. The apparatus of claim 1, wherein the shutoff valve consists of a spring-biased plug arranged to close the liquid outlet in the closed position thereof.

10. An apparatus for pumping a liquid under air pressure from a container having a rim and defining an interior chamber holding the liquid from the bottom of the chamber to a predetermined liquid level, an air space being defined between the liquid level and the rim, the apparatus being disposed and locked on the container above the air space, which apparatus comprises a. a housing defining an air inlet for delivering air into the air space and including two clamps engageable with the rim of the container for disposing and locking the housing on the container, the clamps having respective inner ends, b. means for imparting superatmospheric pressure to the air whereby the air is delivered to the space under said pressure, the presure imparting means including 1. a cylindrical casing mounted between the ends of the clamps and projecting from their surface,
2. a piston received and movably guided in the casing, the piston having a bottom with an outer face and a central, stepped projection, the step in the projection defining a seat,
3. an insert consisting a downwardly tapering conical rim section, an adjoining annular section and a cylindrical hub section projecting upwardly from the annular section, the hub section frictionally engaging the central stepped projection and the upper rim of the hub section engaging the step in the projection which provides the seat for the insert,
4. a membrane loosely mounted on the outer bottom face, the membrane having a circumferential rim sealingly engaging the inner casing wall and a central opening through which the hub section extends, the membrane being held between the outer bottom face of the piston and the annular section of the insert, and
5. an attachment sealingly mounting the casing bottom, c. a check valve in the inlet for preventing the air under pressure from escaping from the space, the casing bottom define a central port in communication with the check valve, d. a tap standpipe in communication with the bottom of the chamber and defining an air channel arranged for connection to the inlet, the air channel being in communication with the space, whereby the superatmospheric air presure in the space above the liquid level pumps the liquid into and through the standpipe, e. a liquid outlet in communication with the tap standpipe, and f. a shutoff valve operable to open and close the outlet.

11. The apparatus of claim 10, further comprising an inwardly projecting collar surrounding and defining the central port in the casing bottom, the collar being sealingly mounted on the attachment, and the check valve and tap standpipe being mounted in the attachement.

12. The apparatus of claim 11, wherein the collar is threadedly mounted on the attachment.

13. The apparatus of claim 10, further comprising a pressure relief valve in communication with the air channel.

* * * * *